US006286814B1

(12) United States Patent
Heyne

(10) Patent No.: US 6,286,814 B1
(45) Date of Patent: Sep. 11, 2001

(54) MOTORCYCLE SUPPORT DEVICE FOR A FLOOR JACK

(76) Inventor: Bernie Heyne, 4048 Elmo Loop, Modesto, CA (US) 95356

( * ) Notice: Subject to any disclaimer, the term of this patent is extended or adjusted under 35 U.S.C. 154(b) by 0 days.

(21) Appl. No.: 09/497,902

(22) Filed: Feb. 4, 2000

(51) Int. Cl.[7] ..... B66F 3/00
(52) U.S. Cl. ..... 254/133
(58) Field of Search ..... 254/133 R, 134, 254/8 B, DIG. 4

(56) References Cited

U.S. PATENT DOCUMENTS 4,113,235 * 9/1978 Hartman ..... 254/131
4,457,492 * 7/1984 Lahti ..... 254/8 B
4,460,158 * 7/1984 Chiesa et al. ..... 254/124
5,211,376 * 5/1993 Anderson ..... 254/134
5,588,639 * 12/1996 Holman ..... 254/133 R
5,769,397 * 6/1998 Dhein ..... 254/134

* cited by examiner

*Primary Examiner*—Robert C. Watson

(57) ABSTRACT

A motorcycle support device for a floor jack for allowing the user to gain access to one's motorcycle from underneath. The motorcycle support device for a floor jack includes a support member having a pair of spaced elongate members having a flat top surface and being interconnected with a cross member which has ends each of which is securely and conventionally attached to a central portion of a respective one of the elongate members; and further includes a boss being centrally disposed on a bottom side of the cross member and being adapted to be removeably received in a hole in the top of a distal end of the arm of a floor jack; and also includes strips of rubber secured to the top surfaces of the elongate members; and further includes strap members having hook members at the end thereof and being securable to holes in the anchor members which are disposed at the ends of the elongate members.

10 Claims, 3 Drawing Sheets

FIG.1
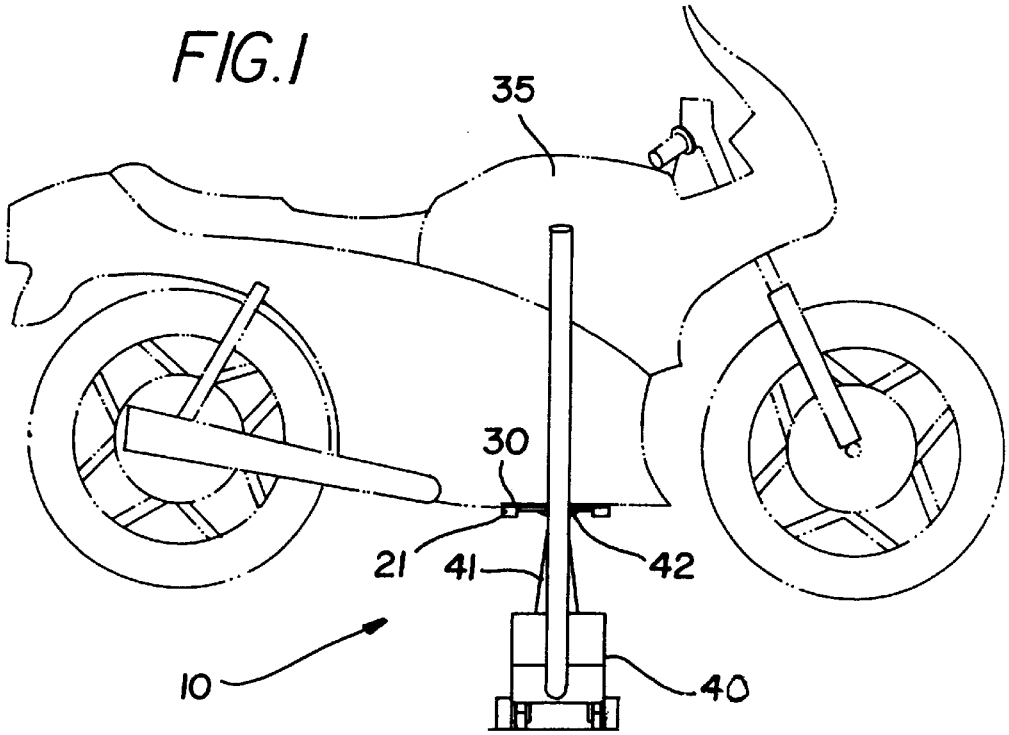
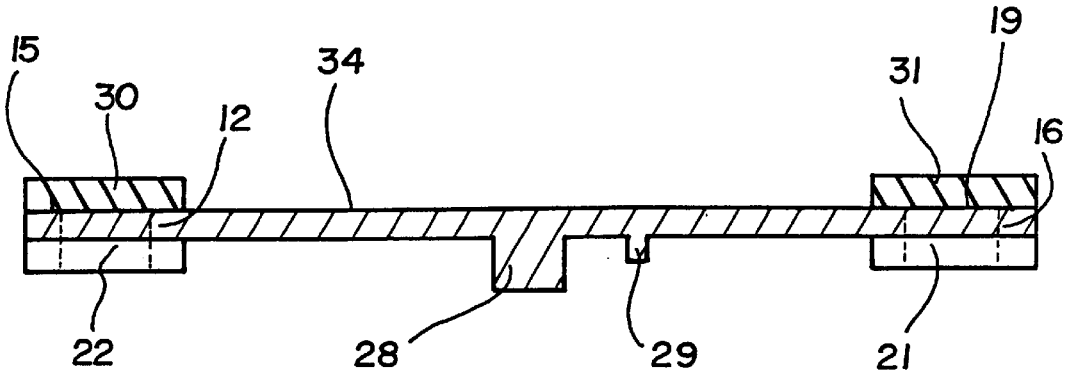
FIG.2

MOTORCYCLE SUPPORT DEVICE FOR A FLOOR JACK

BACKGROUND OF THE INVENTION

1. Field of the Invention

The present invention relates to motorcycle floor jack adaptor plate and more particularly pertains to a new motorcycle support device for a floor jack for allowing the user to gain access to one's motorcycle from underneath.

2. Description of the Prior Art

The use of motorcycle floor jack adaptor plate is known in the prior art. More specifically, motorcycle floor jack adaptor plate heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,769,397; 4,640,495; 2,838,278; 3,628,772; 2,747,837; and U.S. Pat. No. Des. 301,655.

While these devices fulfill their respective, particular objectives and requirements, the aforementioned patents do not disclose a new motorcycle support device for a floor jack. The inventive device includes a support member having a pair of spaced elongate members having a flat top surface and being interconnected with a cross member which has ends each of which is securely and conventionally attached to a central portion of a respective one of the elongate members; and further includes a boss being centrally disposed on a bottom side of the cross member and being adapted to be removeably received in a hole in the top of a distal end of the arm of a floor jack; and also includes strips of rubber secured to the top surfaces of the elongate members; and further includes strap members having hook members at the end thereof and being securable to holes in the anchor members which are disposed at the ends of the elongate members.

In these respects, the motorcycle support device for a floor jack according to the present invention substantially departs from the conventional concepts and designs of the prior art, and in so doing provides an apparatus primarily developed for the purpose of allowing the user to gain access to one's motorcycle from underneath.

SUMMARY OF THE INVENTION

In view of the foregoing disadvantages inherent in the known types of motorcycle floor jack adaptor plate now present in the prior art, the present invention provides a new motorcycle support device for a floor jack construction wherein the same can be utilized for allowing the user to gain access to one's motorcycle from underneath.

The general purpose of the present invention, which will be described subsequently in greater detail, is to provide a new motorcycle support device for a floor jack apparatus and method which has many of the advantages of the motorcycle floor jack adaptor plate mentioned heretofore and many novel features that result in a new motorcycle support device for a floor jack which is not anticipated, rendered obvious, suggested, or even implied by any of the prior art motorcycle floor jack adaptor plate, either alone or in any combination thereof.

To attain this, the present invention generally comprises a support member having a pair of spaced elongate members having a flat top surface and being interconnected with a cross member which has ends each of which is securely and conventionally attached to a central portion of a respective one of the elongate members; and further includes a boss being centrally disposed on a bottom side of the cross member and being adapted to be removeably received in a hole in the top of a distal end of the arm of a floor jack; and also includes strips of rubber secured to the top surfaces of the elongate members; and further includes strap members having hook members at the end thereof and being securable to holes in the anchor members which are disposed at the ends of the elongate members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new motorcycle support device for a floor jack apparatus and method which has many of the advantages of the motorcycle floor jack adaptor plate mentioned heretofore and many novel features that result in a new motorcycle support device for a floor jack which is not anticipated, rendered obvious, suggested, or even implied by any of the prior art motorcycle floor jack adaptor plate, either alone or in any combination thereof.

It is another object of the present invention to provide a new motorcycle support device for a floor jack which may be easily and efficiently manufactured and marketed.

It is a further object of the present invention to provide a new motorcycle support device for a floor jack which is of a durable and reliable construction.

An even further object of the present invention is to provide a new motorcycle support device for a floor jack which is susceptible of a low cost of manufacture with regard to both materials and labor, and which accordingly is then susceptible of low prices of sale to the consuming public, thereby making such motorcycle support device for a floor jack economically available to the buying public.

Still yet another object of the present invention is to provide a new motorcycle support device for a floor jack which provides in the apparatuses and methods of the prior art some of the advantages thereof, while simultaneously overcoming some of the disadvantages normally associated therewith.

Still another object of the present invention is to provide a new motorcycle support device for a floor jack for allowing the user to gain access to one's motorcycle from underneath.

Yet another object of the present invention is to provide a new motorcycle support device for a floor jack which includes a support member having a pair of spaced elongate members having a flat top surface and being interconnected with a cross member which has ends each of which is securely and conventionally attached to a central portion of a respective one of the elongate members; and further includes a boss being centrally disposed on a bottom side of the cross member and being adapted to be removeably received in a hole in the top of a distal end of the arm of a floor jack; and also includes strips of rubber secured to the top surfaces of the elongate members; and further includes strap members having hook members at the end thereof and being securable to holes in the anchor members which are disposed at the ends of the elongate members.

Still yet another object of the present invention is to provide a new motorcycle support device for a floor jack that is convenient, safe and very easy to use to lift and support one's motorcycle.

Even still another object of the present invention is to provide a new motorcycle support device for a floor jack that substantially stabilizes and secures a motorcycle which is raised.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a new motorcycle support device for a floor jack according to the present invention and being used to lift a motorcycle.

FIG. 2 is a cross sectional view of the support member of the present invention.

DESCRIPTION OF THE PREFERRED EMBODIMENT

Figure 3:
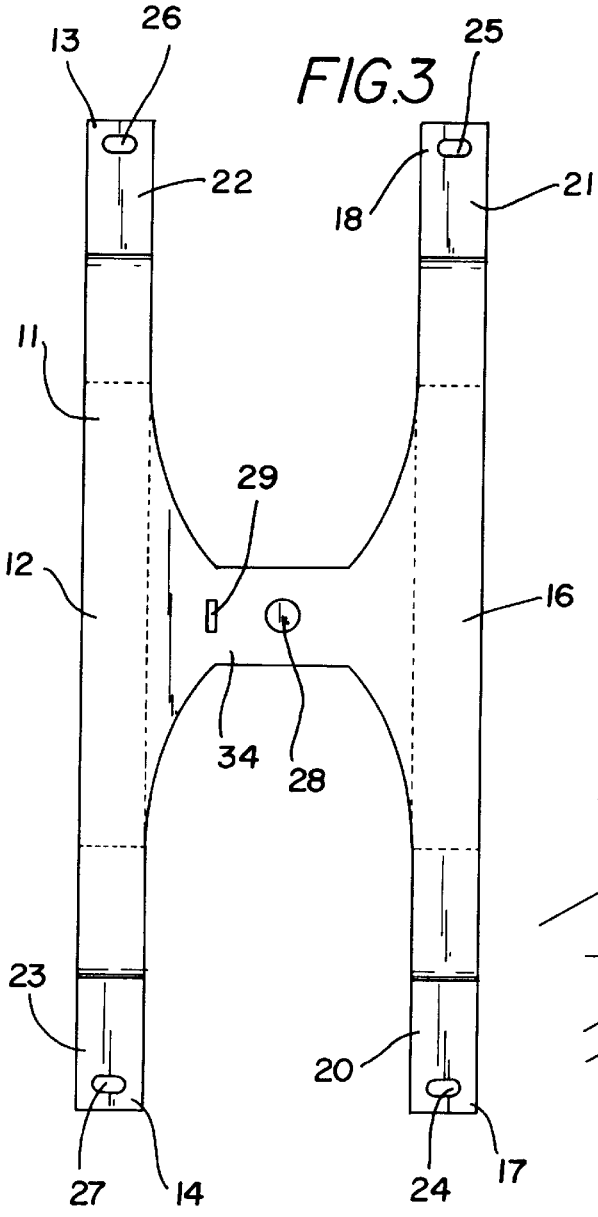
FIG. 3 is a bottom plan view of the present invention.
Figure 4:
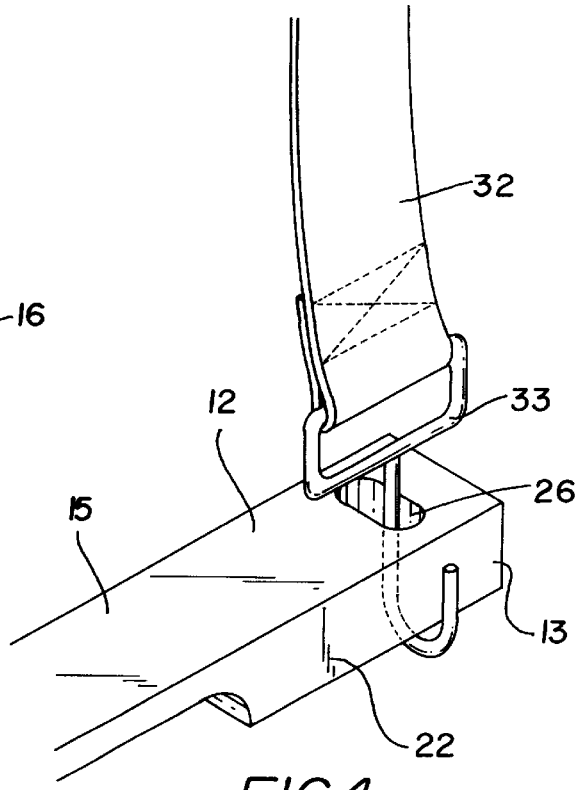
FIG. 4 is a detailed perspective view of one of the anchor members including a strap member of the present invention.
Figure 5:
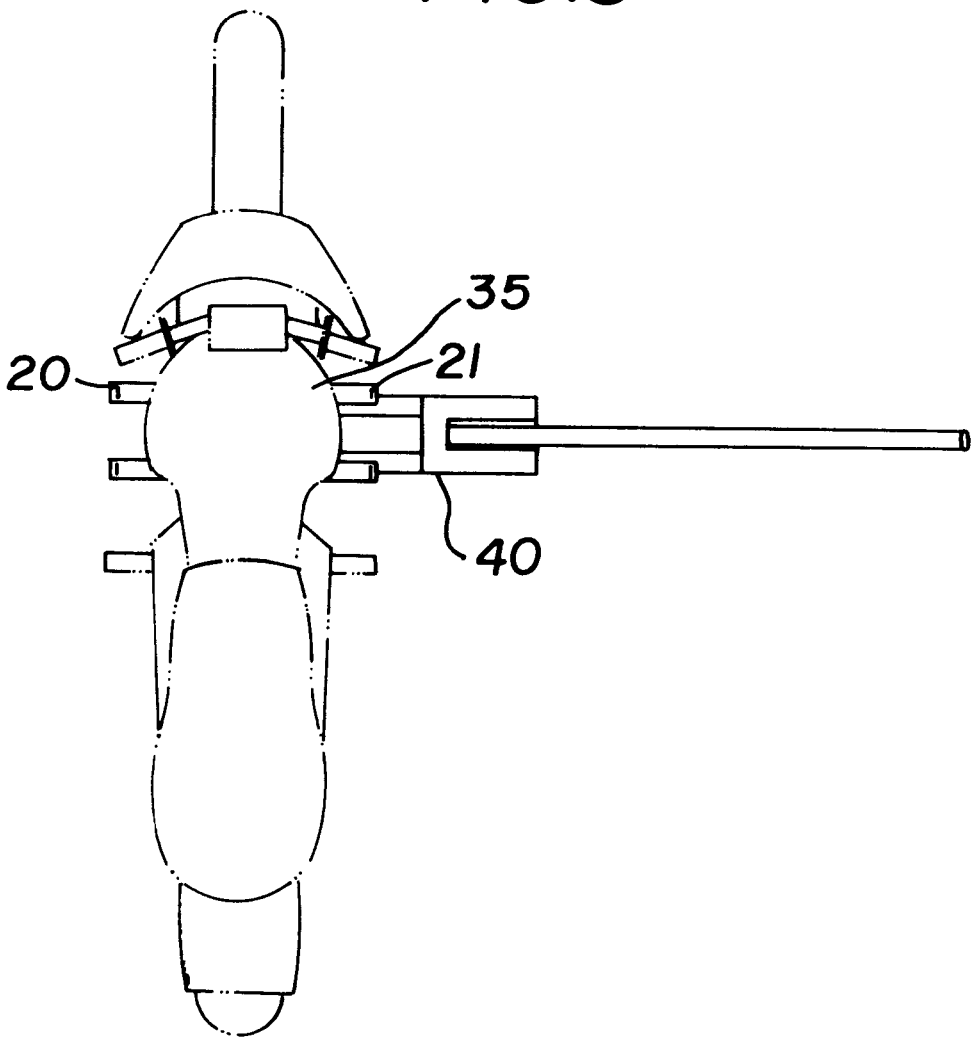
FIG. 5 is a top plan view of the present invention.

With reference now to the drawings, and in particular to FIGS. 1 through 5 thereof, a new motorcycle support device for a floor jack embodying the principles and concepts of the present invention and generally designated by the reference numeral 10 will be described.

As best illustrated in FIGS. 1 through 5, the motorcycle support device for a floor jack 10 generally comprises a conventional floor jack having a base 40, wheels mounted to the base, an upwardly moveable arm 41 securely and conventionally mounted to the base 40, and a hole 42 at a distal end of the arm 41 with the motorcycle lifting attachment 10 comprising a support member 11 including a pair of spaced elongate members 12,16 and a cross member 34 securely and conventionally interconnecting the elongate members 12,16. The cross member 34 has ends each of which is securely and conventionally attached to a central portion of a respective one of the elongate members 12,16. Each of the elongate members 12,16 has opposed ends 13,14,17,18. The cross member 34 is removeably mounted upon the arm 41. Each of the elongate members 12,16 has a generally flat top surface 15,19 and has a defined width. Each of the elongate members 12,16 includes a pair of anchor members 20–23 one being securely and conventionally disposed at each end 13,14,17,18 thereof, each of the anchor members 20–23 having a bole 24–27 extending therethrough from a top to a bottom. The support member 11 further includes a boss 28 centrally and securely and integrally disposed in a bottom side of the cross member 34 and extending downwardly therefrom. The boss 28 is adapted to be removeably received in the hole 42 of the arm 41 for supporting the motorcycle lifting attachment 10. The support member 11 also includes a lug member 29 securely and conventionally disposed on the bottom side of the cross member 34 and is spaced from the boss 28 for engaging about the arm 41 when the motorcycle lifting attachment 10 is removeably mounted upon the arm 41. The support member 11 has a length of approximately 24 inches and a width of approximately 16 inches.

The motorcycle lifting attachment 10 further includes a plurality of protective members 30,31 each of which is securely and conventionally attached to a top side 15,19 of a respective one of the elongate members 12,16 for protecting a frame of a motorcycle 35. Each of the protective members 30,31 is essentially a strip of rubber extending a length of a respective one of the elongate members 12,16. Each of the strips of rubber 30,31 is approximately 4 inches wide.

A means for securely supporting a motorcycle 35 upon the support member 11 includes at least one strap member 32 having ends, and further includes hook members 33 securely and conventionally attached to the ends of the at least one strap member 32 and being adapted to be received through the holes 24–27 in the anchor members 20–23 for securing the at least one strap member 32 to the support member 11, the at least one strap member 32 being adapted to extend about a portion of the motorcycle 35 for the securing thereof.

In use, the user removes a saddle member from the hole 42 in A the arm 41 and mounts the support member 11 upon the arm 41 with the boss 28 being inserted in the hole 42 of the arm 41. The user then moves the floor jack under the motorcycle 35 from the right side of the motorcycle 35 and at an angle generally perpendicular to the motorcycle 35 with the elongate members 12,16 being positioned under the frame of the motorcycle 35, and then wraps the strap members 32 about the motorcycle 35 and hooks the hook members 33 through the holes 24–27 in the anchor members 2–23 to secure the motorcycle 35 to the support member 11. The user uses the floor jack to lift the motorcycle 35 off the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motorcycle lifting attachment for a floor jack which includes a base, wheels mounted to said base, an upwardly moveable arm mounted to said base, and a hole at a distal end of said arm, said motorcycle lifting attachment comprising:

a support member including a pair of spaced elongate members and a cross member interconnecting said elongate members at central portions thereof, each of said elongate members having opposed ends, said cross member being removably mounted upon said arm;

a plurality of protective members each of which is securely attached to a top side of a respective one of said elongate members for protecting a frame of a motorcycle; and a means for securely supporting a motorcycle upon said support member;

wherein each of said elongate members has a generally flat top surface and has a defined width;

wherein each of said elongate members includes a pair of anchor members one being securely disposed at each end thereof;

wherein each of said anchor members has a hole extending therethrough from a top to a bottom;

wherein said support member further includes a boss centrally and securely disposed in a bottom side of said cross member and extending downwardly therefrom, said boss being adapted to be removeably received in said hole of said arm for supporting said motorcycle lifting attachment; and wherein said support member also includes a lug member securely disposed on said bottom side of said cross member and being spaced from said boss for engaging about said arm when said motorcycle lifting attachment is removably mounted upon said arm.

2. A motorcycle lifting attachment for a floor jack as described in claim 1, wherein each of said protective members is essentially a strip of rubbers extending a length of a respective one of said elongate members.

3. A motorcycle lifting attachment for a floor jack as described in claim 1, wherein said means for supporting a motorcycle includes at least one strap member having ends, and further includes hook members securely attached to said ends of said strap member and being adapted to be received through said holes in said anchor members for securing said at least one strap member to said support member, said at least one strap member being adapted to extend about a portion of the motorcycle for the securing thereof.

4. A motorcycle lifting attachment for a floor jack which includes a base, wheels mounted to said base, an upwardly moveable arm mounted to said base, and a hole at a distal end of said arm, said motorcycle lifting attachment comprising:

a support member including a pair of spaced elongate members and a cross member interconnecting said elongate members at central portions thereof, each of said elongate members having opposed ends, said cross member being removeably mounted upon said arm, each of said elongate members having a generally flat top surface and having a defined width, each of said elongate members including a pair of anchor members one being securely disposed at each end thereof, each of said anchor members having a hole extending therethrough from a bottom to a top, said support member further including a boss centrally and securely disposed in a bottom side of said cross member and extending downwardly therefrom, said boss being adapted to be removeably received in said hole of said arm for supporting said motorcycle lifting attachment, said support member also including a lug member securely disposed on said bottom side of said cross member and being spaced from said boss for engaging about said arm when said motorcycle lifting attachment is removeably mounted upon said arm, said support member having a length of approximately 24 inches and a width of approximately 16 inches;

a plurality of protective members each of which is securely attached to a top side of a respective one of said elongate members for protecting a frame of a motorcycle, each of said protective members being essentially a strip of rubbers extending a length of a respective one of said elongate members, each of said strip of rubber being approximately 4 inches wide; and a means for securely supporting a motorcycle upon said support member including at least one strap member having ends, and further including hook members securely attached to said ends of said strap member and being adapted to be received through said holes in said anchor members for securing said at least one strap member to said support member, said at least one strap member being adapted to extend about a portion of the motorcycle for the securing thereof.

5. A motorcycle lifting attachment for a floor jack which includes a base, wheels mounted to said base, an upwardly moveable arm mounted to said base, and a hole at a distal end of said arm, said motorcycle lifting attachment comprising:

a support member including a pair of spaced elongate members and a cross member interconnecting said elongate members at central portions thereof, each of said elongate members having opposed ends, said cross member being removably mounted upon said arm;

a plurality of protective members each of which is securely attached to a top side of a respective one of solid elongate members for protecting a frame of a motorcycle;

means for securely supporting a motorcycle upon said support member;

a boss being mounted on a bottom side of said cross member and extending downwardly therefrom, said boss being adapted to be removably received in said hole of said arm for supporting said motorcycle lifting attachment; and a lug member mounted on said bottom side of said cross member and being spaced from said boss for engaging about said arm when said motorcycle lifting attachment is removably mounted upon said arm.

6. A motorcycle lifting attachment for a floor jack as described in claim 5, wherein each of said elongate members has a generally flat top surface and has a defined width.

7. A motorcycle lifting attachment for a floor jack as described in claim 5, wherein each of said elongate members includes a pair of anchor members one being securely disposed at each end thereof.

8. A motorcycle lifting attachment for a floor jack as described in claim 7, wherein each of said anchor members has a hole extending therethrough from a top to a bottom.

9. A motorcycle lifting attachment for a floor jack as described in claim 5, wherein each of said protective members is essentially a strip of rubbers extending a length of a respective one of said elongate members.

10. A motorcycle lifting attachment for a floor jack as described in claim 5, wherein said means for supporting a motorcycle includes at least one strap member having ends, and further includes hook members securely attached to said ends of said strap member and being adapted to be received through said holes in said anchor members for securing said at least one strap member to said support member, said at least one strap member being adapted to extend about a portion of the motorcycle for the securing thereof.

* * * * *